United States Patent [19]

Rosenau

[11] 4,356,641

[45] Nov. 2, 1982

[54] KILN CONTROL SYSTEM

[75] Inventor: Clifford M. Rosenau, Willow Street, Pa.

[73] Assignee: Armstrong World Industries, Lancaster, Pa.

[21] Appl. No.: 216,557

[22] Filed: Dec. 15, 1980

[51] Int. Cl.[3] ..... F26B 21/08

[52] U.S. Cl. ..... 34/46; 34/48; 34/54; 34/191

[58] Field of Search ..... 34/46, 48, 191, 9.5, 34/13.4, 13.8, 16.5, 50, 54

[56] References Cited

U.S. PATENT DOCUMENTS

| | | | |
|---|---|---|---|
| 2,270,815 | 1/1942 | Vaughn | 34/26 |
| 3,578,298 | 5/1971 | Huribut | 263/32 |
| 3,744,144 | 7/1973 | Weis | 34/16.5 |
| 3,896,558 | 7/1975 | Lovgren | 34/13.8 |
| 4,176,464 | 12/1979 | Randolph | 34/16.5 |
| 4,250,629 | 2/1981 | Lewis | 34/46 |

*Primary Examiner*—Larry I. Schwartz

*Attorney, Agent, or Firm*—Woodcock, Washburn, Kurtz, Mackiewicz & Norris

[57] ABSTRACT

A lumber kiln is controlled by a digital computer which periodically changes the wet bulb set point so that the rate of change of moisture content is maintained approximately constant. Reversible fans which circulate air through the lumber are periodically reversed. When they are reversed, the signals from the temperature sensors are reversed so that the temperature from the sensor at the high pressure end of the circulating air path is always used. A plurality of kilns may be controlled by the same digital computer because the computer is insensitive to variations in the operating parameters of the kilns.

9 Claims, 5 Drawing Figures

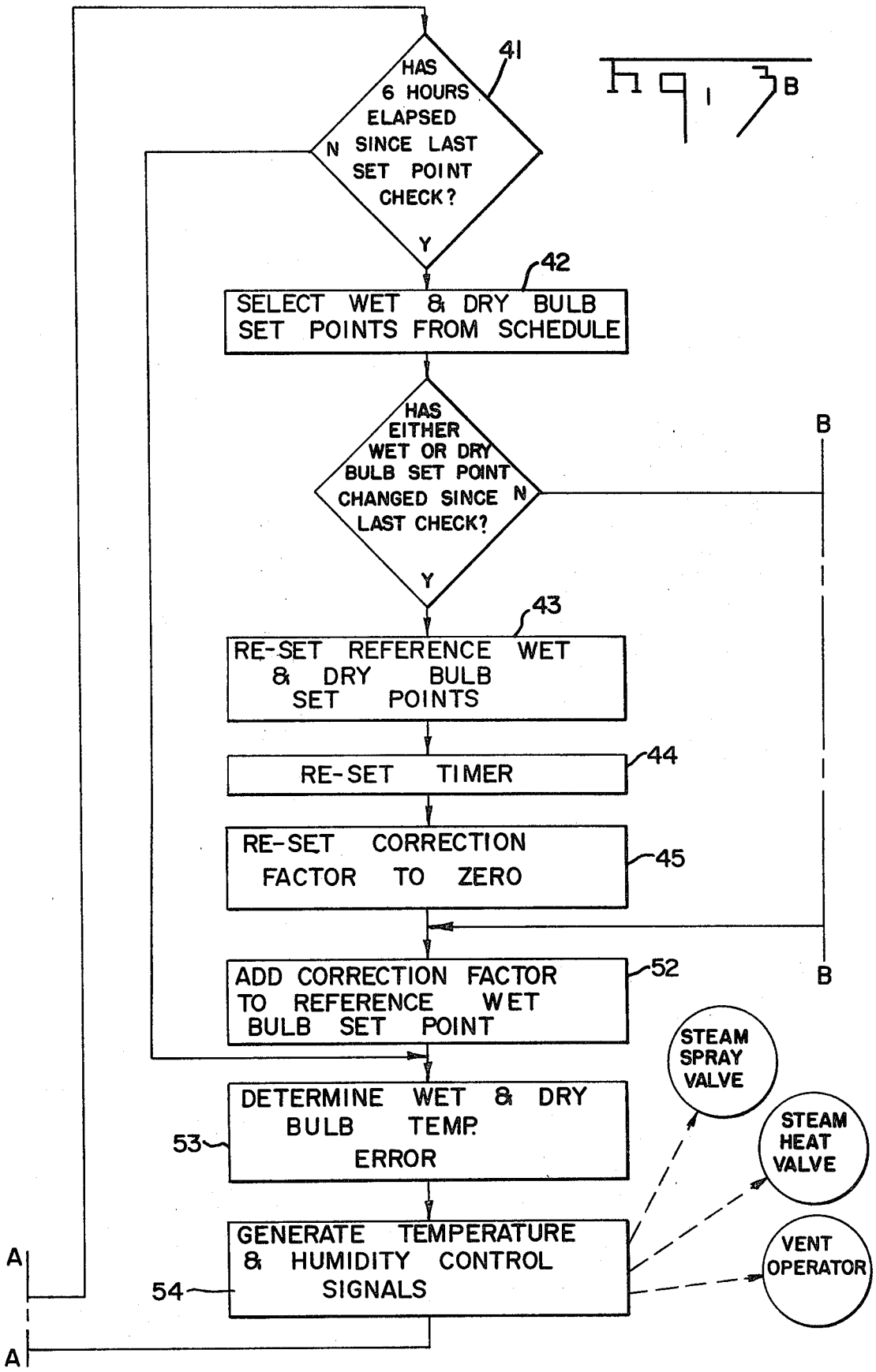
Fig. 3B
HAS 6 HOURS ELAPSED SINCE LAST SET POINT CHECK?
N
Y
41
SELECT WET & DRY BULB SET POINTS FROM SCHEDULE
42
HAS EITHER WET OR DRY BULB SET POINT CHANGED SINCE LAST CHECK?
N
Y
B
RE-SET REFERENCE WET & DRY BULB SET POINTS
43
RE-SET TIMER
44
RE-SET CORRECTION FACTOR TO ZERO
45
ADD CORRECTION FACTOR TO REFERENCE WET BULB SET POINT
52
B
DETERMINE WET & DRY BULB TEMP. ERROR
53
GENERATE TEMPERATURE & HUMIDITY CONTROL SIGNALS
54
STEAM SPRAY VALVE
STEAM HEAT VALVE
VENT OPERATOR
A
A

KILN CONTROL SYSTEM

BACKGROUND OF THE INVENTION

This invention relates to a control system for a lumber kiln and more particularly to maintaining a constant drying rate for the lumber.

Lumber is dried by placing it in a kiln where it is subjected to heat and continuous air flow. Wet bulb and dry bulb temperatures are monitored and steam valves, vents and/or fans are controlled to obtain the desired drying. The difference between the wet bulb and dry bulb temperature is called the "wet bulb depression". The amount of this depression affects the rate of drying of the lumber.

In the typical prior art manually controlled kiln, the moisture content is manually measured. Periodically the operator takes a sample of boards from the load, and an estimate of the moisture content of the boards is obtained by weighing them. From the determination of moisture content the operator determines the appropriate wet bulb and dry bulb set points from a drying schedule, for example the ones supplied by the U.S. Forest Service for different species and thickness of lumber being dried. The operator sets the wet bulb and dry bulb set points on the kiln controller which generates control signals which operate the steam valves and vents to add or subtract heat and/or humidity from the kiln as required to make the kiln conditions match the set points.

Controllers are available for automatically controlling the kiln conditions. For example, the Hildebrandt Company of Germany makes a controller for lumber kilns. In this controller, there is a fixed relationship between moisture content of the lumber and the dry and wet bulb set points. This controller does not produce a constant drying rate.

In U.S. Pat. No. 3,744,144, Weis, the moisture content is monitored by probes which are connected to a sensor which supplies a moisture content signal to the controller 60. The controller 60 functions as a computer in comparing the sensed moisture content signal which a moisture content program such as that set forth in column 4 of the patent. The schedule of column 4 is a typical drying schedule where particular dry bulb and wet bulb temperature set points are specified for particular ranges of moisture content. This system has the disadvantage of changing the set points in steps. The system does not achieve a constant drying rate.

In U.S. Pat. No. 4,176,464, Randolph, the system continuously monitors moisture content by measuring the weight of the load. This load signal is applied to an automatic control circuit 82 which also receives wet and dry bulb signals. In column 6 the patent teaches measuring the rate of change of moisture content and automatically controlling the kiln in response to this measurement. The Randolph patent discloses one system for maintaining a desired rate of change of moisture in the lumber, but it does not recognize that a constant drying rate should be maintained.

Prior art lumber kilns typically have a reversible fan or fans for moving air through the lumber first in one direction and then in the other direction. In U.S. Pat. No. 2,270,815, Vaughn, the fans are reversed when the temperature reaches the point at which continued operation with the same wet bulb depression would cause objectionable checking and cracking. In this way, maximum permissible drying supposedly is achieved.

SUMMARY OF THE INVENTION

In accordance with the present invention, an automatic lumber kiln control system includes a digital computer which produces a variable wet bulb depression to maintain a constant rate of drying of the lumber. By maintaining a constant rate of drying, the lumber can be dried in the shorter time than would otherwise be possible and without cracking or splitting the lumber.

In the system of the present invention, moisture sensors are imbedded in the lumber to measure moisture content. The output of these moisture sensors is applied to a digital computer which generates the rate of change of moisture content. In response to this rate of change, the computer generates a variable wet bulb depression set point. For example, if the measured rate of change of moisture content is less than $1\frac{1}{2}\%$ per day, the microprocessor lowers the wet bulb set point until the rate of change is approximately the desired $1\frac{1}{2}\%$ per day. In this way, the system produces a constant drying rate in the lumber.

One of the features which makes this type of operation possible is the automatic reversal of the wet and dry bulb temperature sensors. These sensors are positioned at both ends of the kiln. The sensors which are used are always the ones on the high pressure end of the circulating air flow. In this way, consistent measurements of wet and dry bulb temperature are obtained. Every three hours the fans are reversed and at that time is automatic switching of the temperature sensors.

In accordance with this invention, the computer control system can be used to control more than one kiln. Since the rate of change of moisture content is determined directly from sensors in the lumber being dried, there is no need for drying schedules which are tailored to each individual kiln. The only parameter which is required is the maximum rate of change of moisture content which the particular load of wood will endure.

The foregoing and other objects, features and advantages of the invention will be better understood from the following more detailed description and appended claims.

SHORT DESCRIPTION OF THE DRAWINGS

Figure 3A:
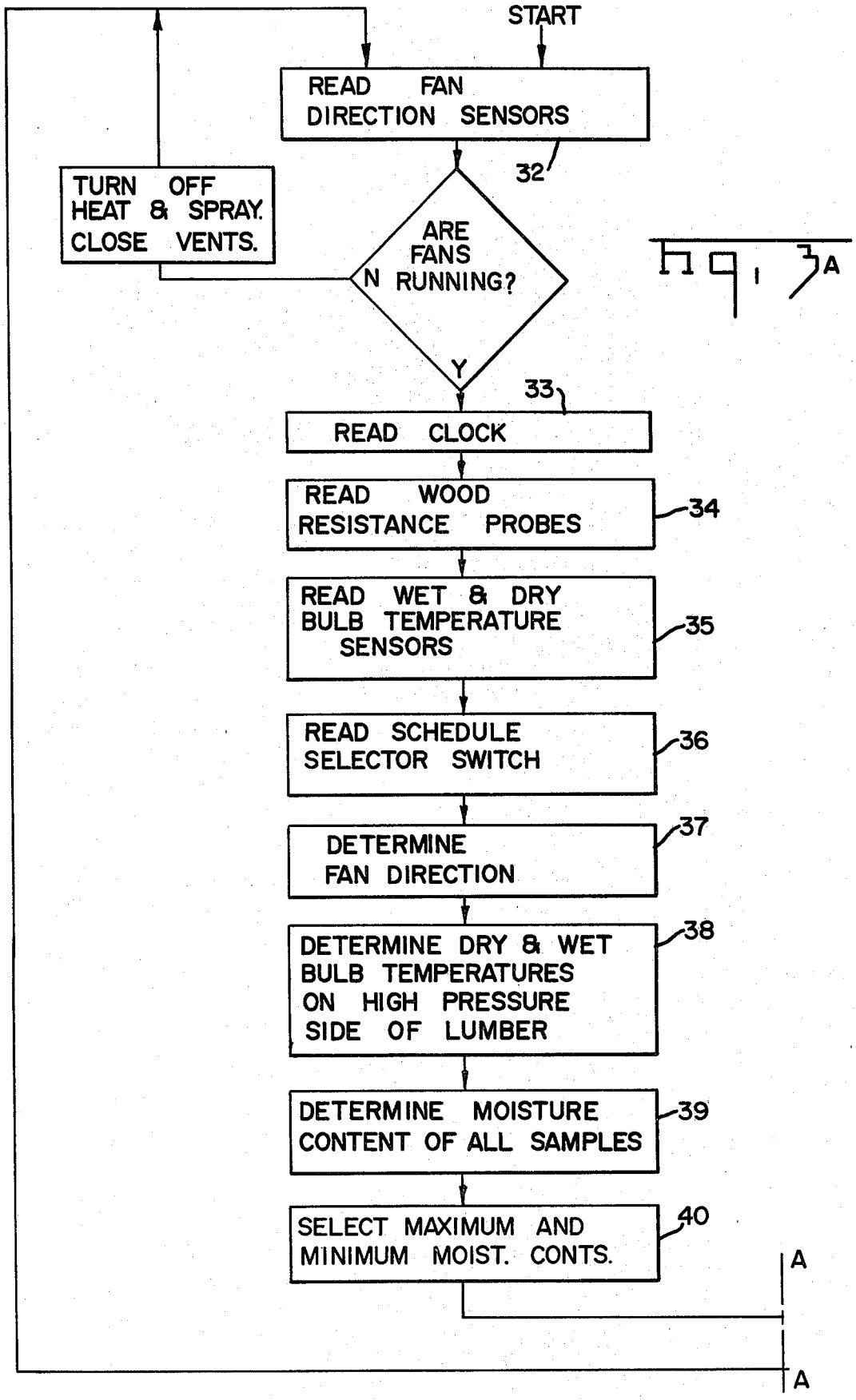
Figure 3C:
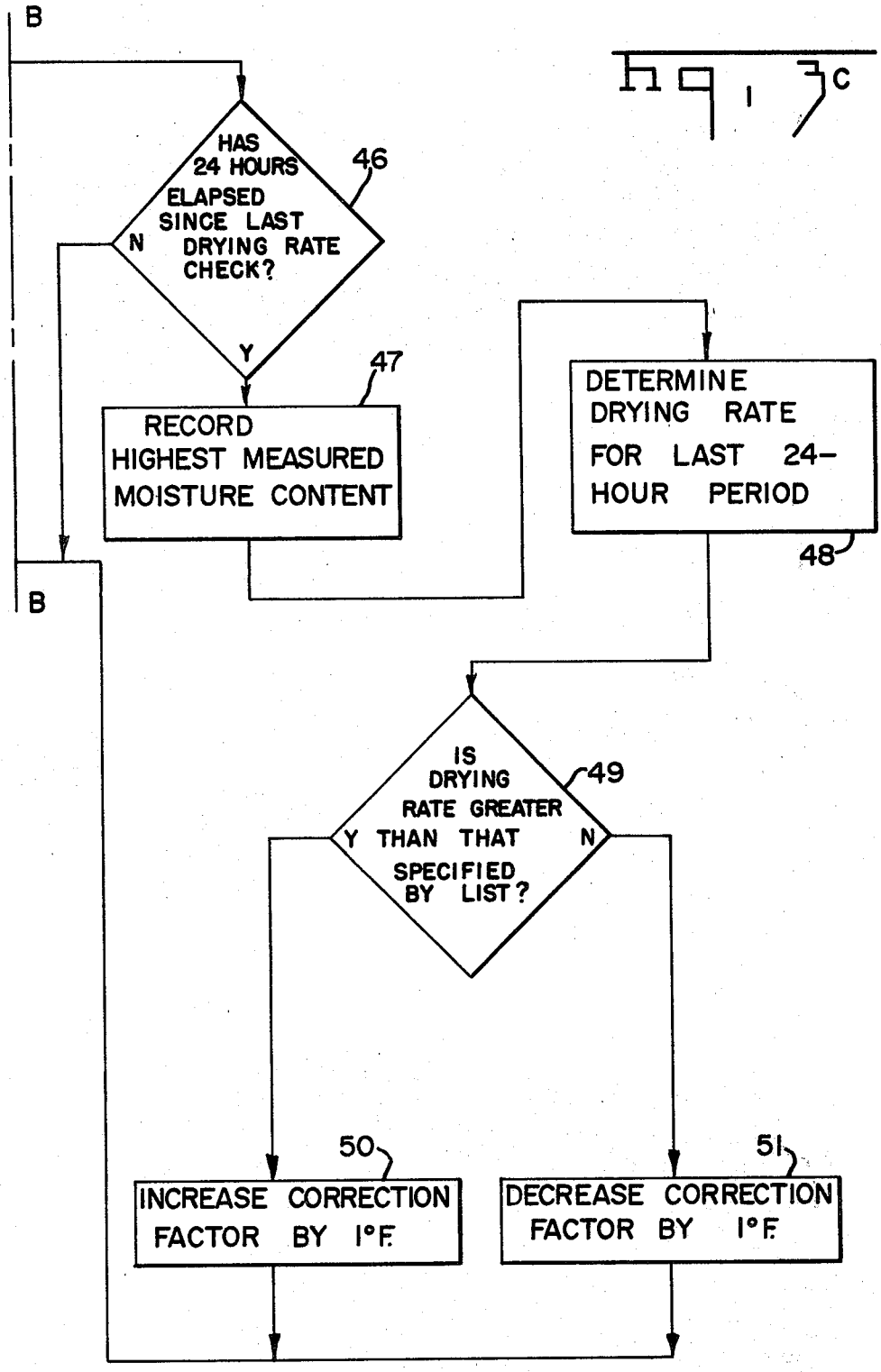
Figure 4:
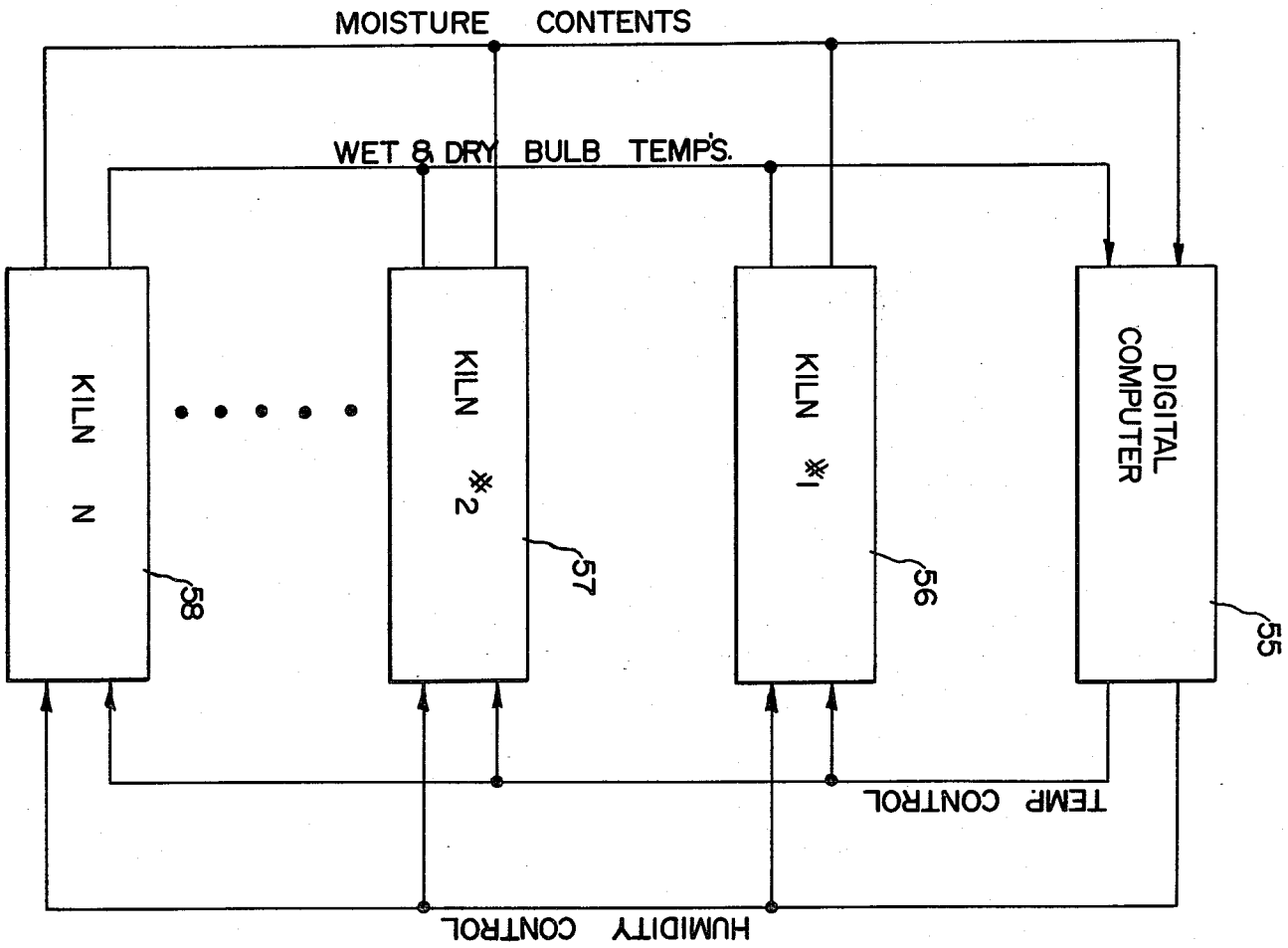

FIGS. 3A-C are flow sheets depicting the operation of the digital computer; and FIG. 4 shows a modification of the invention wherein a plurality of kilns are controlled.

DESCRIPTION OF THE PREFERRED EMBODIMENT

A kiln 11 for drying lumber has temperature control means including heater 12 and humidity control means including steam spray nozzle 13 and vents 14, each being responsive to applied control signals from the digital computer 15. A plurality of moisture sensors 16, 17 . . . 18 are imbedded directly in the lumber. Preferably, one of the moisture sensors, such as 16, is located at the point of known wettest lumber, and another sensor, such as 18, is located at the point of known driest lumber. These moisture sensors are connected to measure wood resistance. Wood resistance is determined by measuring the voltage drop across a reference resistor in series with the wood sample.

Reversible fans 19 circulate air through the lumber. The direction of air flow through the lumber is reversed periodically, in one example every three hours.

Temperature sensors including wet and dry bulb sensors 20 and 21 are positioned in the path of air circulating through the lumber. Another set of wet and dry bulb sensors 22 and 23 are positioned at the other end of the kiln. In accordance with the present invention, the sensors 20, 21, 22, and 23 are connected through switch means in the digital computer 15 so that the computer always receives an output from a temperature sensor at the high pressure end of the path of the recirculating air. That is, when air is circulating from right to left, the inputs from sensors 20 and 21 are used in the digital computer; when air is circulating from left to right, the outputs of sensors 22 and 23 are used by the digital computer 15.

Figure 1:
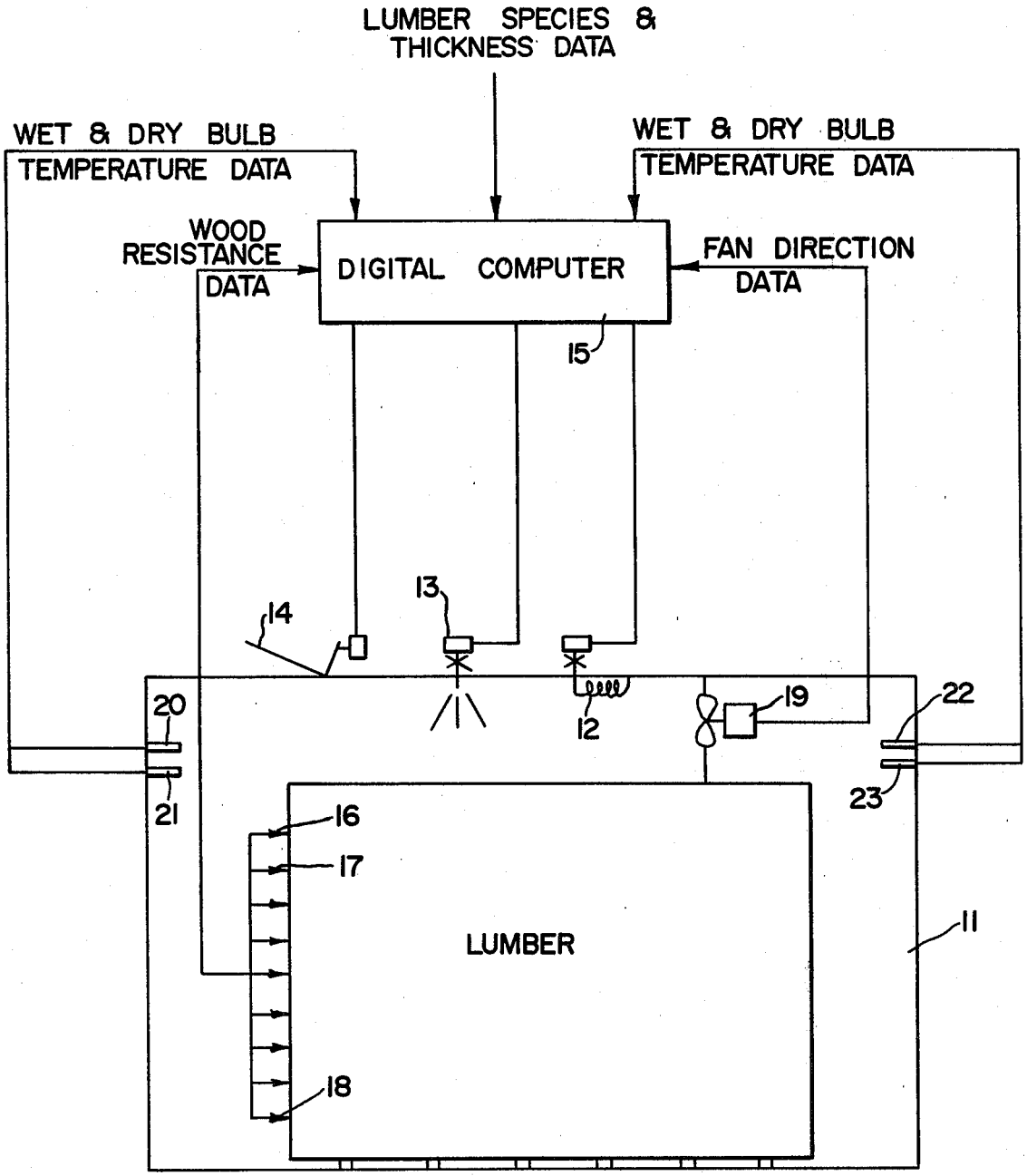
FIG. 1 is a block diagram showing the kiln and the control system.
Figure 2:
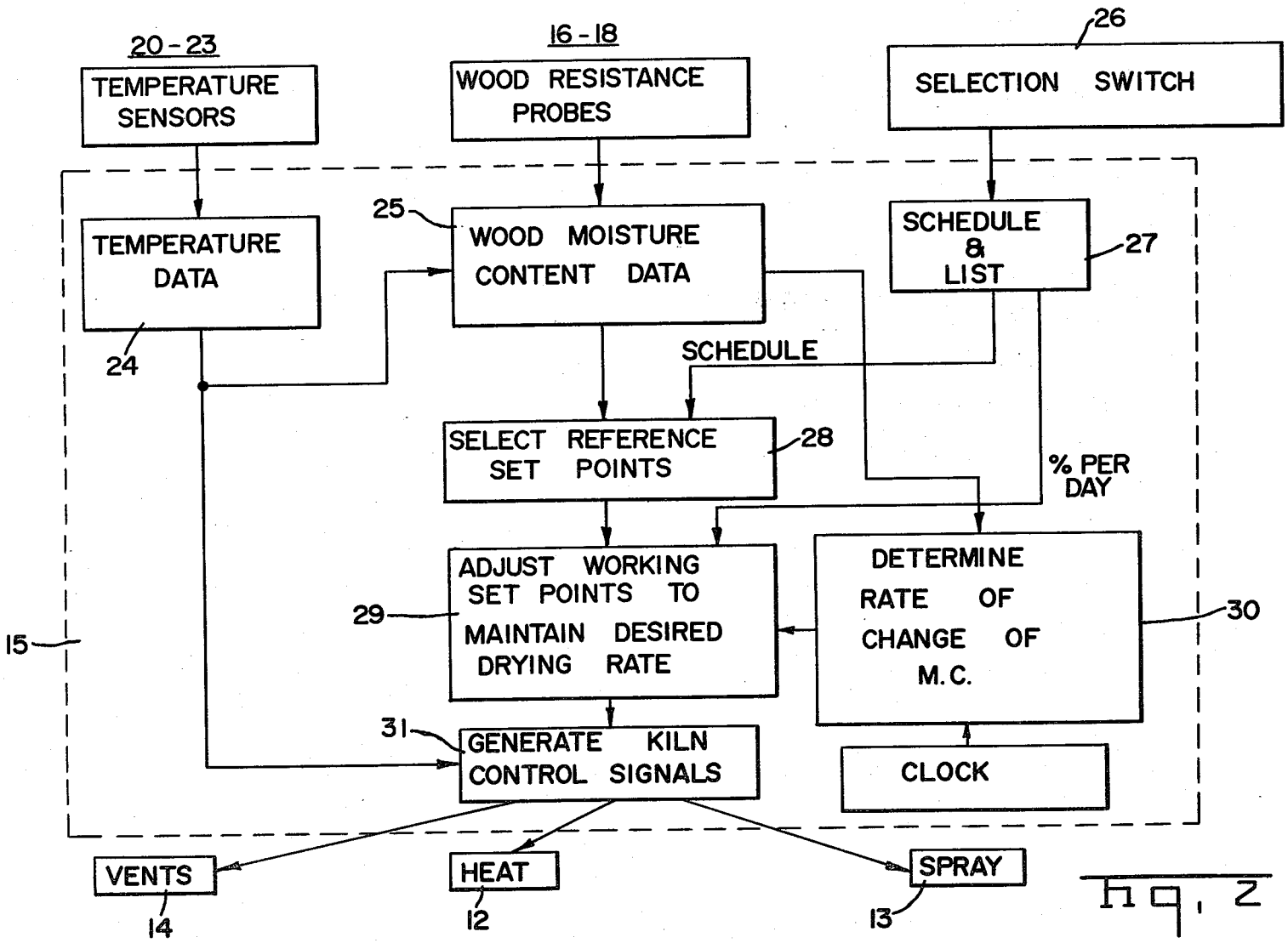
FIG. 2 depicts the operation of the digital computer in more detail.

The digital computer which controls the kiln in accordance with the present invention is shown in FIG. 2. The temperature data from sensors 20–23 is read into memory 24.

The wood resistance probes 16–18 are read into memory and the data is used to generate the wood moisture content data as indicated at 25. The sensors in the wood sample may be stainless steel electrodes driven through the sample perpendicular to the board face. Two electrodes are driven into the board near the center (with reference to the long edge of the face) spaced 2 inches apart in the grain direction. The electrodes are connected through suitable amplifiers to the digital computer which determines moisture content in accordance with $$MC = K_1 + \frac{K_2(T - K_3)^2}{(\log R + K_4)^{K5}}$$

where

MC=sample moisture content (%)

T=sample temperature (°F.)

R=wood resistance (K ohms)

$K_1, K_2 \ldots K_5$=constants

One manner of determining moisture content from wood resistance is described and claimed in co-pending U.S. application Ser. No. 927,887, filed July 25, 1978 and assigned to a common assignee, but other techniques may be employed.

In order to select a drying schedule and a drying rate from a list of drying rates for different woods, the selection switch 26 is provided. Switch 26 has ten positions, each pole of which is connected to a different point on a voltage divider network so that each position inputs a different voltage to the computer. In the example under consideration, these are approximately 0, 1, 2 . . . 9 volts. The inputs from the selection switch 26 are decoded to identify the appropriate schedule for temperature set-point.

Memory 27 contains a list of desired rate of change for moisture content for different thicknesses and species of wood and schedules of drying rates for that wood. For example, when the switch 26 is set to the position for one inch red oak (4/4), the following data in memory 27 is selected.

| LIST | SCHEDULE Set Points | | |
|---|---|---|---|
| 1" Red Oak (4/4) | D.B. | W.B. | Moisture Content |
| Desired Rate of Change | 110° F. | 106° F. | 50% |
| 2.5%/day | 110° F. | 105° F. | 40–50% |
| | 110° F. | 102° F. | 35–40% |
| | 110° F. | 96° F. | 35–30% |
| | 120° F. | 90° F. | 30–25% |

From the foregoing schedule, and from the wood moisture content determined at 25, the reference set-points are selected as indicated at 28. For example, if the moisture content is in the range 40–50%, the dry bulb set-point is 110° F. and the wet bulb set-point is 105° F.

These set-points are periodically adjusted, as indicated at 29, to maintain a constant desired rate of drying of the wood.

The actual rate of change of moisture content in the wood is determined as indicated at 30. The determination of rate of change of moisture content is made by recording the moisture at periodic intervals of time and determining rate of change by the difference over a given time interval.

This actual rate of change is compared with the desired preset rate of change and the wet bulb set-point is adjusted upwardly or downwardly as indicated by the comparison. In this manner, the actual drying rate of the lumber is maintained approximately constant. This is an important advantage because it minimizes drying time without causing splitting which might result from an excessive drying rate.

The wet and dry bulb set-points are used to generate kiln control signals as indicated at 31. The dry bulb temperature control signal controls the heater 12 and the wet bulb control signal controls steam spray 13 and vents 14.

An example of a digital computer procedure for implementing the present invention is shown in FIGS. 3A-C. The settings of the fan direction relays are read as indicated at 32 to determined which way the fans are blowing. If the fans are off, the steam heat, steam spray, and vents are shut off until the fans restart. If the fans are on, the clock is read as indicated at 33, and the wood resistance probes are read as indicated at 34. The wet and dry bulb temperature sensor are read as indicated at 35. The selection switch 26 (FIG. 2) is read to determine a drying schedule and a desired preset rate of change of moisture as indicated at 36. The direction of the recirculating air is determined from the setting of the fan direction relays as indicated at 37. The dry and wet bulb temperatures on the high pressure side of the lumber are selected as indicated at 38. The moisture content from all of the samples is determined from the wood resistance probe readings as indicated at 39 and the maximum and minimum moisture contents are selected as indicated at 40.

As indicated at 41 and 42, every six hours, the moisture content is used to select dry and wet bulb set-points from the schedule. If there has been a change in moisture content which requires a change in set-point, the wet and dry bulb set-points are reset as indicated at 43, the timer is reset as indicated at 44, and the correction factor added to the set-points is reset to 0 as indicated at 45.

As indicated at 46, (FIG. 3C) every twenty-four hours a determination is made whether the actual drying rate is equal to the preset drying rate selected from the list. The highest measured moisture content of the wood is recorded as indicated at 47. From the difference in moisture content recorded over a twenty-four hour interval, the drying rate is determined as indicated at 48. This actual drying rate is compared with the preset drying rate from the list as indicated at 49. If the actual drying rate is greater than the preset drying rate, a correction factor of 1° F. is added to the set-point as indicated at 50. Conversely, if the actual drying rate is less than the preset rate from the list, the set-point is decreased by 1° F., as indicated at 51. These correction factors are added to the wet bulb set-point selected from the schedule as indicated at 52. (FIG. 3B) These set-points are used to generate control signals for the humidity and temperature control means of the kiln. First, the error between the wet and dry bulb temperatures and wet and dry bulb set-points are determined as indicated at 53. Then the control signals are generated as indicated at 54.

Control signals are generated for the heaters, steam spray, and vents. The dry bulb temperature controls the heaters and wet bulb temperature controls the spray and vents. The outputs are generated using proportional-integral-differential (PID) control procedures which tolerate variable time intervals between updates. The integral component of the control signal is:

$$I = I + R(D\phi - Dl)T$$

where I is the integral component, R is the integral constant, $D\phi$ is the temperature set-point, Dl is the temperature, and T is the elapsed time since the last update. (The = in the expression is a computer notation meaning "is replaced by", not a mathematical expression of equality.) The program only updates the value of I if the rate of temperature change is less than a specified value, for example 3° F./min. The control signal is given by:

$$C = G[D\phi - Dl + I + (D\phi - Dl - Fl)(P/T)]$$

Where C is the control signal, Fl is the temperature error ($D\phi - Dl$) from the last update, P is the differential constant, and G is the proportional gain which is a constant.

The generation of these control signals is carried out as indicated at 54.

FIG. 4 shows a modification of the invention wherein a single digital computer 55 controls a plurality of kilns 56, 57 . . . 58. It will be appreciated by those skilled in the art that the operation of the digital computer can easily be expanded to control a plurality of kilns. The present invention is particularly adaptable to multiple kiln operation because it is relatively insensitive to variations in operation between the kilns. The system of the present invention maintains a substantially constant drying rate regardless of variations in the operating parameters of the kilns.

The following description of the components of one actual operating system is given by way of example only.

The kiln itself is a standard Moore Products unit with steam heat, steam spray humidification, and roof vents, all pneumatically controlled. The digital computer 15 is a Cromemco Z-2 microcomputer with 48*k* of random access memory, dual 8-inch floppy disk drives, a Mountain Hardware real-time clock, a Data Translation 4-channel digital-to-analog output board with 4–20 ma current outputs, and two Burr-Brown analog-to-digital input boards with software-programmable gain giving full scale sensitivities of about −10 to +10 volts (at a gain of one) to about −0.0098 to +0.0098 volts (at a gain of 1024). The steam heat, steam spray humidification, and roof vents are controlled by three Moore Products current-to-pressure transducers which convert 4–20 ma inputs to 3–15 psi pneumatic outputs. The steam vents are controlled by three Honeywell Model 4805 pneumatically-positioned proportioning valves which accept 3–15 psi signals and modulate steam flow to the kiln heaters (2 valves) and the humidifier spray. The vents are controlled by a Honeywell Model 05 Air-O-Motor proportioning pneumatic activator for the vent system. The wet and dry bulb temperature sensors are two Honeywell wet/dry bulb psychrometers with RTD temperature sensors. The resistance sensors are connected to four Action Instruments RTD transmitters which drive the RTD sensors and deliver a 0–5 vdc signal proportional to the sensor resistance. A 20 vdc regulated power supply is used in wood resistance measurements. Software used with the system consists of a Cromemco Disk Operating System (CDOS) and Cromemco 16K Extended Basic supplied on floppy disks and loaded into the computer's memory each time the unit is powdered up. The operating system is in BASIC as specified by the flow sheet of FIGS. 3A-C.

While a particular embodiment of the invention has been shown and described, various other modifications are within the true spirit and scope of the invention. The appended claims are, therefore, intended to cover all such modifications.

What is claimed is:

1. In a kiln for drying lumber having temperature control means and humidity control means each being responsive to applied control signals, temperature sensors producing signals representing the dry and wet bulb temperatures in said kiln, and a control system comprising:

at least one moisture sensor embedded in said lumber; and a digital computer having:

means responsive to the output of said moisture sensor for producing a digital signal representing rate of change of moisture content in said lumber;

means for comparing said signal representing rate of change with a desired preset rate of change of moisture content;

means responsive to the aforesaid comparison for periodically updating a wet bulb set point, so that said rate of change of moisture content is maintained approximately constant;

means responsive to said wet bulb set point to produce said applied control signals for said humidity control means; and means responsive to said dry bulb set point to produce said applied control signal for said temperature control means.

2. A plurality of kilns of the type recited in claim 1, each kiln being controlled by said digital computer which further comprises:

means for producing dry and wet bulb set points for each of said kilns in response to the measured rate of change in moisture in the lumber in each of said kilns.

3. The control system recited in claim 1 comprising at least two of said moisture sensors at first and second locations, one location being at the point of known wettest lumber and the second location being at the point of known dryest lumber.

4. The control system recited in claim 3 wherein said computer includes means for selecting the signal from one of said sensors representing the highest measured moisture content of said lumber; and means for applying the signal representing the highest measured moisture content to said means for producing a digital signal representing rate of change of moisture content.

5. The system recited in claim 1 wherein said means for producing a digital signal representing rate of change of moisture content comprises:

means for recording said signal representing highest measured moisture content at periodic intervals of time; and means for determining rate of change from the difference in moisture content recorded over said intervals.

6. The system recited in claim 1 wherein said computer has a memory containing a list of desired preset rate of change of moisture content for different thicknesses and species of wood; and means for selecting a desired preset rate of change from said list corresponding with the thickness and species of said wood.

7. In a kiln for drying lumber having temperature control means and humidity control means each being responsive to applied control signals, temperature sensors producing signals representing the dry and wet bulb temperatures in said kiln, and a control system comprising:

a plurality of moisture sensors embedded in said lumber;

a digital computer having:

means responsive to the output of said moisture sensors for producing a digital signal representing rate of change of moisture content in said lumber;

means for comparing said signal representing rate of change with a desired preset rate of change of moisture content;

means responsive to the aforesaid comparison for periodically updating a wet bulb set point, so that said rate of change of moisture content is maintained approximately constant;

means responsive to said wet bulb set point to produce said applied control signals for said humidity control means;

means responsive to said dry bulb set point to produce said applied control signal for said temperature control means; and reversible fans for circulating air through said lumber, at least two of said temperature sensors being at spaced locations in the path of air circulating through said lumber;

means for periodically reversing said reversible fans; and switch means in said computer for applying signals representing wet and dry bulb temperatures from the temperature sensor located at the high pressure end of said path of air circulating through said lumber to said means for comparing, said switch means being actuated each time said fans are reversed so that said means for comparing receive an output from a temperature sensor at the high pressure end of said path.

8. In a kiln for drying lumber having temperature control means and humidity control means each being responsive to applied control signals, temperature sensors producing signals representing the dry and wet bulb temperatures in said kiln, and a control system comprising:

a plurality of moisture sensors embedded in said lumber;

a digital computer having:

a digital memory containing a schedule of wet and dry bulb set points;

means for selecting from said schedule a wet and dry bulb set point corresponding with the moisture content of said lumber;

means responsive to the output of said moisture sensor for producing a digital signal representing rate of change of moisture content in said lumber;

means for comparing said signal representing rate of change with a desired preset rate of change of moisture content;

means responsive to the aforesaid comparison for periodically updating a wet bulb set point, so that said rate of change of moisture content is maintained approximately constant;

means responsive to said wet bulb set point to produce said applied control signals for said humidity control means; and means responsive to said dry bulb set point to produce said applied control signal for said temperature control means.

9. The system recited in claim 1 wherein said means for updating includes means for adding a correction factor to the wet bulb set-point selected from said schedule.

* * * * *